US008096146B1

(12) United States Patent
Adlakha

(10) Patent No.: US 8,096,146 B1
(45) Date of Patent: Jan. 17, 2012

(54) APPARATUS TO CREATE A JEWELRY SETTING FOR PRECIOUS STONES WHERE THE STONES APPEAR TO FLOAT IN THE SETTING

(75) Inventor: Afshan Adlakha, Maharashtra (IN)

(73) Assignee: Jewelex New York, Ltd., New York, NY (US)

( * ) Notice: Subject to any disclaimer, the term of this patent is extended or adjusted under 35 U.S.C. 154(b) by 871 days.

(21) Appl. No.: 12/075,661

(22) Filed: Mar. 13, 2008

(51) Int. Cl.
*A44C 17/02* (2006.01)

(52) U.S. Cl. ..... 63/28; D11/91; D11/92

(58) Field of Classification Search ..... 63/26, 27, 63/28, 13; D11/91–92
See application file for complete search history.

(56) References Cited

U.S. PATENT DOCUMENTS

| | | | | | |
|---|---|---|---|---|---|
| 195,304 | A | * | 9/1877 | Pic et al. | 63/28 |
| 424,749 | A | * | 4/1890 | Zirnkilton | 63/4 |
| 795,109 | A | * | 7/1905 | Dover | 63/26 |
| 860,204 | A | * | 7/1907 | Fishel | 63/28 |
| 898,166 | A | * | 9/1908 | Aucoc | 63/37 |
| 951,926 | A | * | 3/1910 | White | 63/33 |
| 964,625 | A | * | 7/1910 | Doran | 63/28 |
| 1,001,377 | A | * | 8/1911 | Fairbrother | 63/28 |
| 2,069,598 | A | * | 2/1937 | Arpels | 63/26 |
| 2,080,317 | A | * | 5/1937 | Jaeckel | 63/28 |
| 2,141,363 | A | * | 12/1938 | Rigollet | 63/29.1 |
| 2,163,814 | A | * | 6/1939 | Swarovski | 264/274 |
| D141,696 | S | * | 6/1945 | Ostier | D10/31 |
| 2,538,090 | A | * | 1/1951 | Ferragamo | 63/4 |
| 2,584,207 | A | * | 2/1952 | Holl | 63/27 |
| 3,071,940 | A | * | 1/1963 | Schneider | 63/15 |
| 3,255,611 | A | * | 6/1966 | Doherty | 434/81 |
| 3,483,716 | A | * | 12/1969 | Stenzler | 63/15 |
| 3,626,718 | A | * | 12/1971 | Schneider | 63/29.1 |
| 3,733,851 | A | * | 5/1973 | D'Apuzzo | 63/43 |
| 4,503,687 | A | * | 3/1985 | Tessler et al. | 63/28 |
| 4,554,800 | A | * | 11/1985 | Moon | 63/23 |
| 4,731,913 | A | * | 3/1988 | Plantureux et al. | 29/10 |
| 4,813,246 | A | * | 3/1989 | Richards | 63/26 |
| 5,072,601 | A | * | 12/1991 | Slowinski | 63/28 |
| 5,115,649 | A | * | 5/1992 | Amber | 63/26 |
| 5,123,265 | A | * | 6/1992 | Ramot | 63/28 |
| 5,170,643 | A | * | 12/1992 | Porcell, Jr. | 63/13 |
| 5,285,659 | A | * | 2/1994 | Bardisbanyan | 63/26 |
| 5,419,159 | A | * | 5/1995 | Muller | 63/28 |
| 5,423,196 | A | * | 6/1995 | Pollack | 63/28 |
| 5,437,167 | A | * | 8/1995 | Ambar | 63/26 |
| 5,520,017 | A | * | 5/1996 | Vivat | 63/29.1 |
| 5,649,434 | A | * | 7/1997 | Itzkowitz | 63/26 |
| D383,085 | S | * | 9/1997 | Nyqvist | D11/86 |

(Continued)

*Primary Examiner* — Robert Sandy
*Assistant Examiner* — Abigail E Morrell
(74) *Attorney, Agent, or Firm* — Thomas I. Rozsa

(57) ABSTRACT stones of a jewelry piece including a diamond which is set through an invisible stone mounting so as to make the stone appear to be "floating" in the jewelry piece. The invention also includes the method of manufacturing the jewelry setting with a "floating" stone therein. The invisible stone mounting for the stone includes a collet which retains the stone, and means by which the collet is affixed to the interior sidewall of the jewelry piece. The method can include directly affixing the collect to the interior sidewall of the jewelry piece so that the setting is shielded by the stone or including a short metal connecting member by which the collect is affixed to the interior sidewall of the jewelry piece with the collet and short metal connecting member shielded by the stone. The affixation method can include welding.

12 Claims, 4 Drawing Sheets

U.S. PATENT DOCUMENTS 5,690,477 A * 11/1997 Haimoff ..... 164/9
5,713,219 A * 2/1998 Itzkowitz ..... 63/26
5,848,539 A * 12/1998 Ouzounian ..... 63/28
D409,518 S * 5/1999 Ho ..... D11/91
6,067,818 A * 5/2000 Winkler ..... 63/26
6,112,552 A * 9/2000 Hoffman ..... 63/26
6,318,121 B1 * 11/2001 Pachauer ..... 63/26
6,412,303 B1 * 7/2002 Lee ..... 63/3
6,453,700 B1 * 9/2002 Avril ..... 63/26
6,493,912 B1 * 12/2002 Ho ..... 29/10
6,532,765 B1 * 3/2003 Hurwitz ..... 63/26
6,550,275 B2 4/2003 Steinberg
D474,993 S * 5/2003 Ambar ..... D11/76
6,591,633 B2 * 7/2003 Pachauer ..... 63/26
6,606,102 B1 * 8/2003 Odom ..... 715/745
D569,758 S * 5/2008 Dholakiya ..... D11/91
7,546,749 B1 * 6/2009 Biren ..... 63/15
D620,386 S * 7/2010 Deruelles ..... D11/82
D622,174 S * 8/2010 Deruelles ..... D11/82
D626,449 S * 11/2010 Deruelles ..... D11/82
2003/0056536 A1 * 3/2003 Ubhayakar ..... 63/26
2005/0005639 A1 * 1/2005 Shagalov ..... 63/32
2008/0053148 A1 * 3/2008 Cohen ..... 63/26
2008/0209943 A1 * 9/2008 Mattar ..... 63/13
2010/0020649 A1 * 1/2010 Kurtze ..... 368/241
2010/0275652 A1 * 11/2010 Ghanimian ..... 63/26

* cited by examiner

APPARATUS TO CREATE A JEWELRY SETTING FOR PRECIOUS STONES WHERE THE STONES APPEAR TO FLOAT IN THE SETTING

BACKGROUND OF THE INVENTION

1. Field of the Invention

The present invention is related to the field of jewelry and more particularly to setting precious stones in piece of jewelry to provide enhanced beauty and uniqueness to the appearance of the stones in the jewelry piece.

2. Description of the Prior Art

The following 13 patents and published patent applications are the closest prior art references which are related to the present invention.

1. U.S. Pat. No. 2,141,363 issued to Louis Rigollet and assigned to Rubel Brothers Limited on Dec. 27, 1938 for "Jewelry Setting" (hereafter the "Rigollet Patent");

2. U.S. Pat. No. 4,813,246 issued to Camille Richards on Mar. 21, 1989 for "Method Of Setting Precious And Semi-precious Stones" (hereafter the "Richards Patent");

3. U.S. Pat. No. 5,072,601 issued to Christopher Slowinski on Dec. 17, 1991 for "Diamond Setting" (hereafter the "Slowinski Patent");

4. U.S. Pat. No. 5,123,265 issued to Boaz Ramot on Jun. 23, 1992 for "Invisible Gemstone Setting" (hereafter the "Ramot Patent");

5. U.S. Pat. No. 5,423,196 issued to John Pollack on Jun. 13, 1995 for "Method Of Mounting Gems Flush To One Another In An Article Of Jewelry, And Articles Of Jewelry Produced By Such Method" (hereafter the "Pollack Patent");

6. U.S. Pat. No. 5,520,017 issued to Oren Vivat and assigned to Oron Vivat; Alon Vivat on May 28, 1996 for "Jewelry Items With Invisible Gemstone Settings And Methods Of Assembly Therefore" (hereafter the "Vivat Patent");

7. U.S. Pat. No. 5,690,477 issued to Manny Hainoff and assigned to Nili Jewelry, Corp. on Nov. 25, 1997 for "Invisible Setting Method For Jewelry" (hereafter the "Hainoff Patent");

8. U.S. Pat. No. 5,713,219 issued to Israel Itzkowitz and assigned to Ambar Diamonds, Inc. on Feb. 3, 1998 for "Invisible Setting For Precious Stones For Jewelry" (hereafter the "Itzkowitz Patent");

9. U.S. Pat. No. 6,112,552 issued to Paul J. Hoffman and assigned to Michael Anthony Jewelers, Inc. on Sep. 5, 2000 for "Gemstone Setting And Method Of Using" (hereafter the "Hoffman Patent");

10. U.S. Pat. No. 6,493,912 issued to Nelson Chi-Kai Ho and assigned to China Diamond Production Company Limited on Dec. 17, 2002 for "Stone Setting Methods" (hereafter the "Ho Patent");

11. U.S. Pat. No. 6,532,765 issued to Robert Hurwitz and assigned to Sandberg & Sikorski Diamond Corp. on Mar. 18, 2003 for "Jewelry Stone Assembly" (hereafter the "Hurwitz Patent");

12. United States Published Patent Application No. 2003/0056536 to Vivek V. Ubhayakar on Mar. 27, 2003 for "Princess Cut Invisible Stone Setting" (hereafter the "Ubhayakar Published Patent Application"); and 13. U.S. Pat. No. 6,550,275 issued to Daniel R. Steinberg and assigned to Daniel R. Steinberg on Apr. 22, 2003 for "Rounded Gemstone Setting" (hereafter the "Steinberg Patent").

The Rigollet Patent discloses a jewelry setting, including a cup like member which has two or more oppositely disposed grips or tongues to engage grooves or recesses formed in the gemstone. The cup like member which retains the jewel in this invisible setting manner is applied to the mounting for gems and jewelry by soldering or welding the same to such mountings.

The Richards Patent discloses an invisible setting for stones by forming slight notches at the angles of the cutlet in such a way that the depth of the notches is small and the distance separating the bottom of the two opposite notches is very much greater than the width of the table of the stone. In addition, a metal matrix is used to hold the stones.

The Slowinski Patent discloses a square or princess cut diamond 14 which has a table 38 at the upper end, a girdle 40 and an inverted pyramid-shaped pavilion 42 which defines four facets 44 which converge at a tip 56 at the bottom of the diamond. Notches 46 are cut in the stone with prongs 34 in the side wall extending into the notches to retain the stones in an invisible manner. In general, this Patent discloses the concept of having a princess cut diamond with grooves cut within the girdle portion on at least three faces and having projections extending into the grooves to retain the stone in an invisible manner.

The Ramot Patent also discloses the concept of an invisible gemstone setting. In this case it is close to a princess cut diamond where there are essentially grooves cut in the girdle portion immediately below the girdle portion and having the stones retained by the sidewalls of a mounting with what are referred to as ribs inside the mounting penetrating the grooves. Therefore, the stones appears to be invisibly set.

The Pollack Patent again discloses the concept of having grooves cut within the stone and prongs transversely extending into the grooves to retain the stones in an invisible manner. FIG. 2 shows how the longitudinal channels 22 receive and hold the fully mounted gems 12 in place. Each of the channels 22 is provided with an opposed inwardly directed pair of locking ribs 30. The ribs each seat within a mating longitudinal locking groove 32 along the adjacent side of the associated gems. As best shown in FIG. 5, the locking pins are set within the pavilion so that the stones themselves can have their edges touch and the retaining pins are invisible.

The Vivat Patent has an excellent discussion of the prior art to show what is considered to be known with respect to invisible setting and stones. Specifically, the patent states: "To better illustrate the approach of the prior art, a conventional invisible diamond setting within a ring is now described with reference to FIGS. 1-4. FIG. 1 illustrates a ring 10 with an invisible diamond setting 12 made up of a matrix of several rows and columns of diamonds 14. FIG. 2 illustrates that diamonds 14 are inserted in grooves 16 defined by walls 18 prepared in a gemstone region 20 of ring 10. Grooves 16 are either parallel to the short axis of gemstone region 20 as shown in FIG. 3 or the long axis of gemstone region 20 as shown in FIG. 4. Walls 18 are cut so as to prepare a T-shaped cross bar 22 having prongs 24 for intergaging cut-outs 26 formed beneath girdle 28 of diamonds 14 so as to secure diamonds 14 in invisible diamond setting 12. Grooves 16 preferably extend through the plane of gemstone region 20 such that the tips 30 of diamonds 14 overlie holes 32 for improving the brilliance of diamonds 14." The prongs are slidably received within the cut channels of the stones and do not penetrate the stones in a transverse direction.

The Haimoff Patent, which is for the concept of an invisible setting, specifically states: "The stones 10 are of specific sizes as designated for each model and are pre-cut by an experienced diamond cutter who cuts grooves 11 of specific size and depth into the stones (see FIG. 7). The stones 10 are then set on opposite sides of the metal (see FIGS. 6*b* and 6*c*) by exerting pressure against the sidewalls 12 in such manner that the stones 10 are both now in seated position in the walls 12 (see FIG. 6*a*) and also fit onto the metal bar 6 (or bars) (see FIG. 7*a*). In the ring shown in FIG. 6, a groove 11 on only one side of the stones 10 is necessary. The other side of the stones 10 do not need the cut, in this instance, because it is being set in the channel wall 2 on its outside edge. Once the stones 10 are set, the metal bar 6 holds the stones 10 toward the center of the ring and provides a strong support at the center where the two rows of stones 10 meet (see FIGS. 6*b*, 6*c*)." In addition, the patent also discloses the method of creating jewelry with this plurality of cut grooves.

The Itzkowitz Patent discloses a diamond having a girdle with oppositely located flattened portions. Each of the flattened portions has a cut out with sloped walls. The girdle preferably has facets at a circumference except at its flattened portion. The diamond is set into a barrel having a ridge member comprising a prong dimension to fit into the respective cutout and to frictionally engage one of the slope walls of the cutout, thereby, rigidly securing the diamond to the barrel. In addition, the innovation of this invention is that the walls are sloped and not horizontal.

The Hoffman Patent is another variation on cutting a groove into the stone for an invisible setting, which states: "A gemstone setting is provided having channels into which grooved gemstones are snapped and secured. Each channel is provided with opposing, flexible prong members extending from the base of the gemstone setting. As the grooved gemstone are snapped into the channels, the prong members flex outwardly as the gemstones are pushed downwardly into the channels, such prong members snapping into engagement with the grooves on the gemstones to securely hold the gemstones within such channels. When the channels of the gemstone setting have been filled with gemstones, the gemstone setting is rendered invisible." The patent discusses the use of this setting. In numerous gemstones from the disclosure "The gemstone setting of the current invention may be used in various jewelry items. In the preferred embodiment, it is used as an invisible gemstone setting placed within a ring (FIG. 5). Further, the gemstone setting of the current invention may be made as a separate setting from the ring and then inserted or fastened to the ring once the gemstones are secured within the gemstone setting. Alternatively, the gemstone setting may be incorporated within the ring as a unitary piece before the insertion of the stones. Moreover, the same setting can be used for pendants, brooches, earrings, or any other jewelry piece with a setting for stones."

The Ho Patent discloses a method of invention to produce stone set jewelry including the step of forming at least one affixation groove within the stone to be set in the jewelry. A stone to be set with the present method should have an upper and a lower portion of the stone. In accordance with the invented method the affixation groove should be formed in the lower portion of the stone such that it is hidden from view when the upper portion of the stone is viewed. A heat setting method is disclosed for improving the bond between the pavilion of the stone and the wax model used in the casting process. The method also includes the deposition of a mounting material within the affixation grove by applying a conventional casting method. Finally, any excess deposited mounting material can be removed and the stone affixed to the article of jewelry via the mounting material such that the mounting material of a completed article of jewelry is not visible when the stone is viewed from the upper portion thereof. In addition, new articles of jewelry formed from the methods of producing jewelry are also disclosed.

The Hurwitz Patent discloses a jewelry assembly which creates an appearance of a space between one or more diamonds. Specifically, the patent states: "As best depicted in FIGS. 2-4, stone 17 is invisibly set within window 16 by means of a hidden metal box 23. As is well known in the art, stone 17 comprises a table or top portion 29, a girdle portion 31 which terminates to an outer circumference 32, and a pavilion portion 33 formed below girdle portion 14. In order to invisibly set stone 17 within metal box 23, a plurality of grooves 35 are formed in pavilion portion 33 just below girdle portion 31 of stone 17. Depending upon the specific design, grooves 35 may comprise two pairs of grooves, with the grooves of each pair disposed opposite each other, thereby providing a total of four grooves formed at substantially the same level in pavilion portion 33 of stone 17."

The Ubhayakar Patent, which is a published patent application, discloses a concept of cutting a channel groove into the stone and having a prong 15 from the side wall extending to retain the stone in an invisible manner.

Finally, the Steinberg Patent discloses a gemstone setting with a rounded gemstone with outer faceted surfaces, each gemstone forming an outwardly contoured or convex gemstone configuration which is invisibly set in flush, surface to surface, mating relation within the setting. A section of rounded gemstone is cut away, leaving a concave inset within and a curved concave inner surface on the gemstone. This concave configuration allows the partially cut away gemstone to mate in flush, surface to surface relation with the convex outer surface of the adjacent gemstone. Grooves within the side facets of the gemstone invisibly set the gemstones in position within supporting housings. The setting of gemstones in this fashion, employing surface to surface flush mating contact, can be used in infinite jewelry designs which employ rounded, curved, edge, contoured or generally convex configured gemstones.

There is a significant need to provide stones of a jewelry piece including diamonds which are set through an invisible stone mounting so that the stones appear to be "floating" in the jewelry piece to significantly improve ornamentation and beauty of the setting.

SUMMARY OF THE INVENTION

The present invention is related to stones of a jewelry piece including a diamond which is set through an invisible stone mounting so as to make the stone appear to be "floating" in the jewelry piece. The invention also includes the method of manufacturing the jewelry setting with a "floating" stone therein. The invisible stone mounting for the stone is comprised of a collet which retains the stone, and means by which the collet is affixed to the interior sidewall of the jewelry piece. The method can include directly affixing the collet to the interior sidewall of the jewelry piece so that the setting is shielded by the stone or including a short metal connecting member by which the collet is affixed to the interior sidewall of the jewelry piece with the collet and short metal connecting member shielded by the stone. The affixation method can include welding.

The stone such as a diamond is comprised of a top crown, a bottom tip, a girdle having the largest outer size of the stone, and a pavilion portion. Within the pavilion portion, there are a multiplicity of facets, which converge at the bottom tip. A multiplicity of grooves such as three identical grooves, which are cut into respective facets, are spaced to be positioned immediately beneath the girdle.

The collet serves as a housing to affix the stone, comprising a body having an interior chamber, an exterior side and a multiplicity of vertically extending extensions such as three identical extensions which are spaced at the top of the collet to extend upwardly. Each of the extensions is comprised of a claw or prong, which is positioned at the top or adjacent the top of the extension to project inwardly towards the interior chamber of the collet.

The claws or prongs are designed to match the respective grooves cut in the stone to thereby affix the stone to the collet through insertion of a respective claw or prong into a respective groove of the diamond or other precious stone when the pavilion portion of the stone is positioned into the interior chamber of the collet. The sidewall of the collet is affixed to an interior sidewall of the jewelry piece through direct affixation such as welding or by affixation through a short metal connecting member which is affixed at opposite ends to the collet sidewall and interior sidewall of the jewelry piece by affixation means such as welding, so that an outer edge of the girdle is positioned adjacent the interior sidewall of the jewelry piece. In this setting, the collet or the short metal connecting member and the collet are invisible from an outside view, since they are shielded by the top portion of the stone including the girdle which has the largest size. Therefore, the stone which is set through the invisible stone mounting appears to be "floating" in the jewelry piece when viewed from above the jewelry piece.

Applying the invisible stone mounting, the present invention method involves the manufacture of a multiplicity of the floating stones which are affixed to the respective collets in a jewelry piece, wherein a part of each of the collets are positioned adjacent the interior sidewall of the jewelry piece, and the rest of the collets are positioned within the jewelry piece. The method of the present invention is comprised of the steps of creating a model of the jewelry piece; connecting each of the collets positioned adjacent the interior wall of the jewelry piece to the interior sidewall of the jewelry piece and connecting the collets positioned within the jewelry piece to each other. Therefore, the present invention method causes the stones to appear to be floating in the jewelry piece, wherein the present invention method is further comprised of the steps of putting the model through a vulcanization process to create a rubber mold and creating a wax impression which has the same impression as the mold, setting the stones, and casting the jewelry item in a precious metal.

It is an object of the present invention to provide a stone of a jewelry piece including a diamond which is set through an invisible stone mounting so that the stone appears to be "floating" in the jewelry piece, which significantly enhances the ornamental beauty and aesthetic appearance of the jewelry piece. The invisible stone mounting for the stone is comprised of a collet of the jewelry piece which retains the stone, and a short metal connecting member which is connected at respective opposite ends to the sidewall of the collet and to the interior sidewall of the jewelry piece.

It is also an object of the present invention to provide the collet which serves as a housing to retain a stone, comprising a body having an interior chamber, an exterior sidewall and a multiplicity of extensions such as three identical extensions spaced at the top of the collet and which extend upwardly, wherein each of the extensions is comprised of a claw or prong positioned at the top or adjacent the top of each of the extensions and which project inwardly towards the interior chamber. The stone is comprised of a crown, a bottom tip, a girdle having the largest outer size of the stone, a pavilion portion having a multiplicity of facets, and a multiplicity of grooves such as three identical grooves cut into the stone on respective facets and which are positioned immediately beneath the girdle. Each claw or prong is designed to match a respective groove which has been cut into the stone to thereby affix the stone to the collet through insertion of a claw or prong into a respective groove of the stone when the pavilion portion of the stone is placed into the interior chamber of the collet.

It is an additional object of the present invention to provide the collet retaining the stone which is affixed to the interior sidewall of the jewelry piece through either a direct connection of the collet sidewall to the interior sidewall of the jewelry piece or through a short metal connecting member connected at opposite ends to the collet sidewall and to the interior sidewall of the jewelry piece, wherein an outer edge of the girdle of the stone is positioned adjacent the interior sidewall of the jewelry piece. In this setting, the short metal connecting member and the top of the collet are invisible from an outside view, since they are shielded by the top portion of the stone including the girdle which has the largest size. This causes the stone which is set through the invisible mounting to appear to be "floating" in the jewelry piece when the jewelry piece is viewed from above.

It is a further object of the present invention to provide a multiplicity of stones in a jewelry piece wherein each stone is set through the respective invisible stone mounting having the respective short metal connecting member so that the stones appear to be "floating" in the jewelry piece to significantly improve the aesthetic beauty of the jewelry piece.

It is still a further object of the present invention method to create an invisible stone mounting for a multiplicity of stones to give the stones the appearance that they are floating in the jewelry piece comprising the steps of creating a model of the jewelry piece, connecting each of the collets positioned adjacent the interior wall of the jewelry piece to the interior sidewall of the jewelry piece and connecting the collets positioned within the jewelry piece to each other. Therefore, the present invention method causes the stones to appear to be floating in the jewelry piece, wherein the present invention method is further comprised of the steps of putting the model through a vulcanization process to create a rubber mold and creating a wax impression which has the same impression as the mold, setting the stones, and casting the jewelry item in a precious metal.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is related to precious stones of a jewelry piece including diamonds which are set through an invisible stone mounting to appear to be "floating" in the jewelry piece. Referring to FIGS. 1 to 7, there is illustrated the structure of the present invention floating stones, wherein the structure of the present invention is comprised of a stone 10, a sidewall 100 of a jewelry piece 102, and a collet 40.

Figure 1:
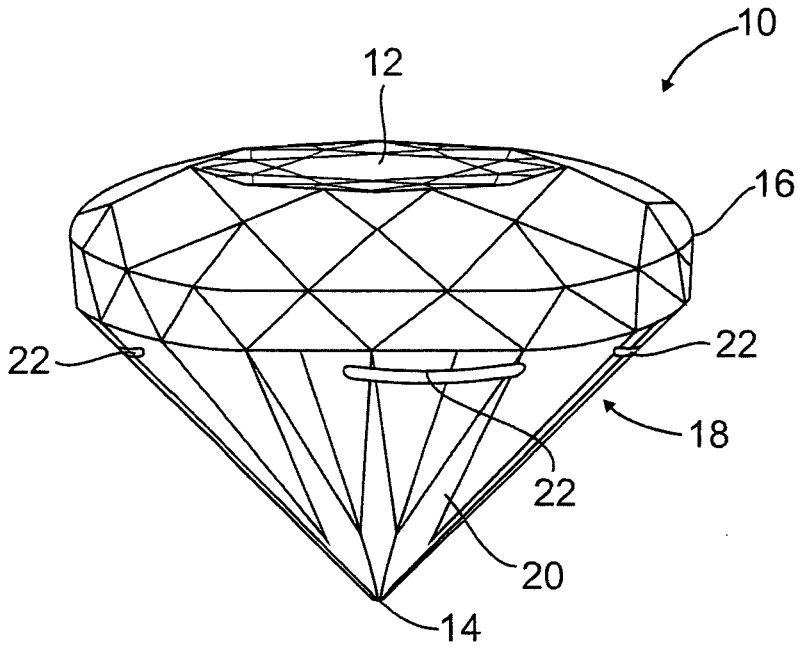
FIG. 1 is a perspective view of a precious stone such as a diamond with grooves cut into the pavilion portion of the stone at a location beneath the girdle.
Figure 3:
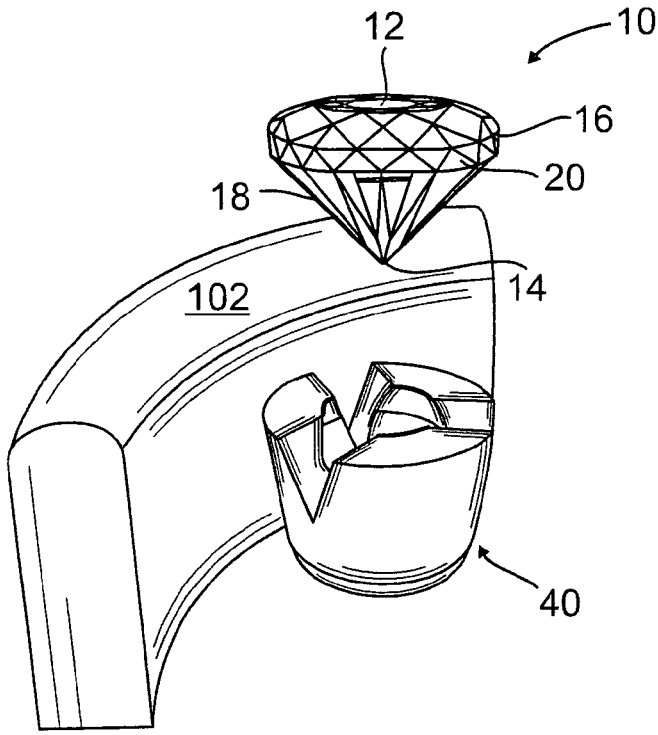
FIG. 3 is an exploded view of the stone, collet and a portion of the interior sidewall of the jewelry piece.

As illustrated in FIGS. 1 and 3, the stone such as a diamond 10 is comprised of a crown 12, a bottom tip 14, a girdle 16 having the largest outer size of the diamond, and a pavilion portion 18. Within the pavilion portion 18, there is a multiplicity of facets 20, which converge at the bottom tip 14. A multiplicity of grooves such as three identical grooves 22 which serve as fastening receiving means, are cut into respective facets 20 and spaced to be positioned adjacent and beneath the girdle 16.

Figure 2:
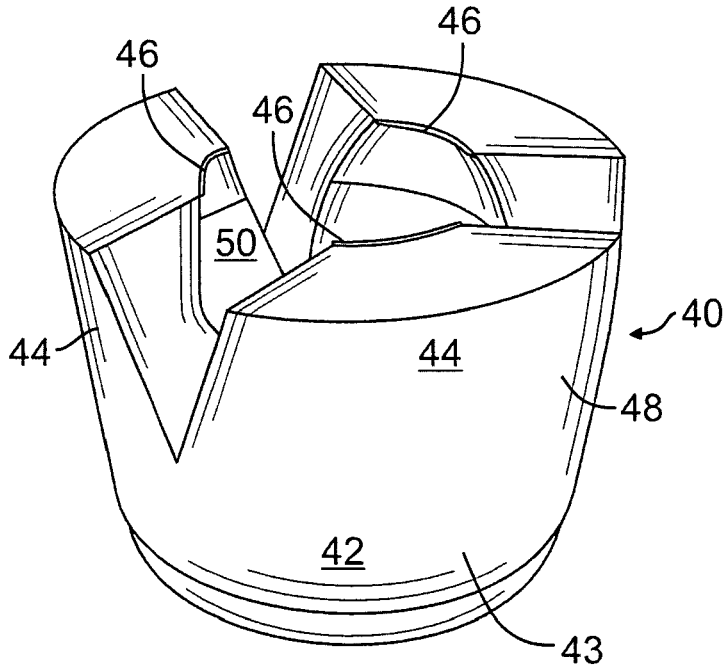
FIG. 2 is a perspective view of a collet of the present invention.

Referring to FIGS. 2 and 3, the collet 40, which serves as a housing to retain the diamond 10, is comprised of a body 48 having an interior chamber 50, surrounded by a sidewall 42 having a exterior sidewall 43 and a multiplicity of extensions such as three identical extensions 44. The extensions 44 are spaced at the top of the collet 40 to extend upwardly, wherein each of the extensions is comprised of a claw or prong 46 which is positioned at the top or adjacent the top of the extension to project inwardly towards the interior chamber 50.

The claws or prongs 46 are designed to match the respective grooves 22 which are cut into the diamond 10. Therefore, the diamond 10 is affixed to the collet 40 through connection of the respective diamond grooves 22 and collet claws 46, when the pavilion portion 18 of the diamond 10 is placed into the interior chamber 50 of the collet 40.

Figure 4:
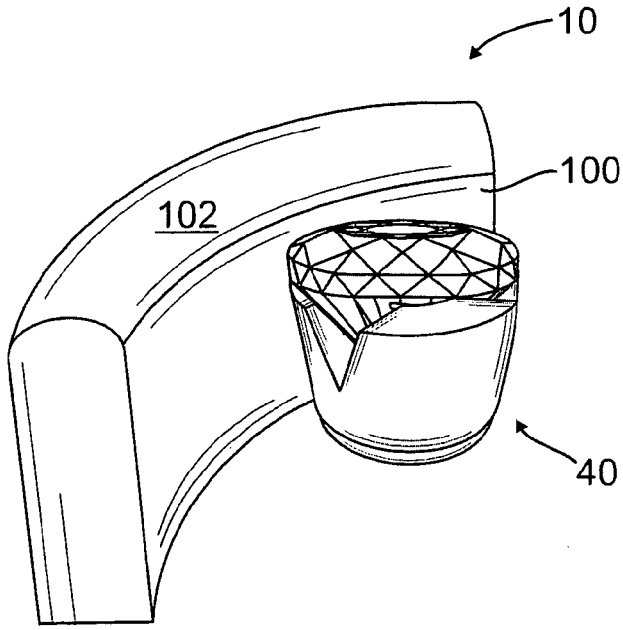
FIG. 4 is a perspective view of the stone retained in the collet before the collet is affixed to a portion of the interior sidewall of the jewelry piece.
Figure 5:
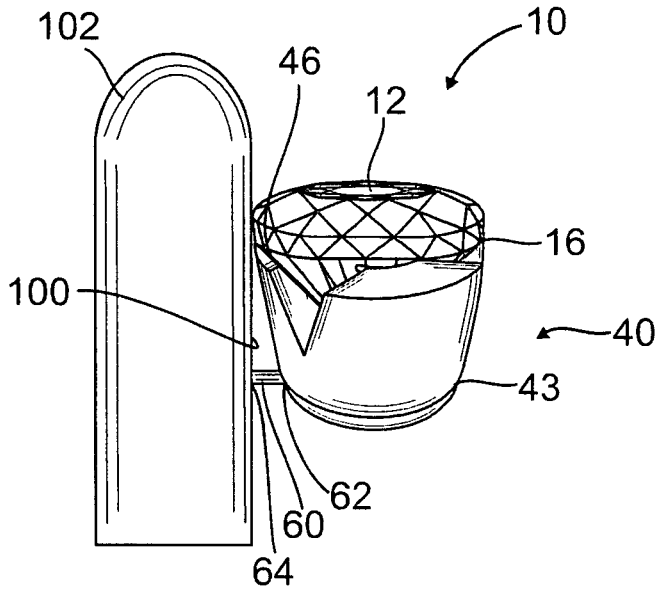
FIG. 5 is a cross sectional view of a collet retaining a stone and affixed to the interior sidewall of a jewelry piece.
Figure 6:
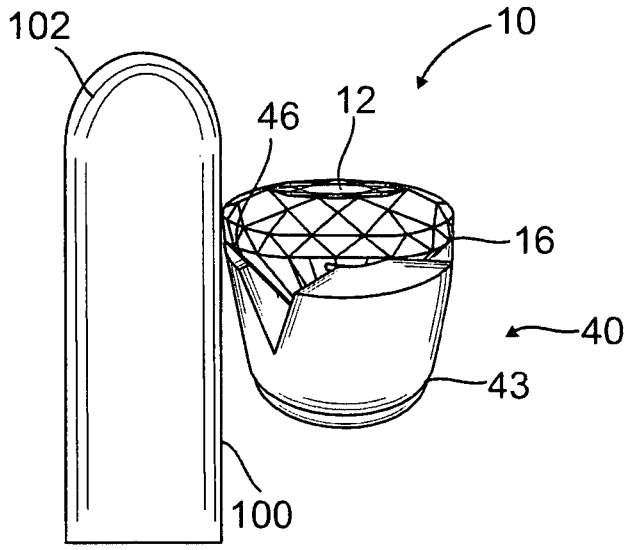
FIG. 6 is a side view of the interior of the jewelry piece showing a collet retaining a stone and affixed to the interior sidewall of a jewelry piece.

FIG. 4 illustrates the diamond 10 retained within the collet 40 and before the collet 40 is affixed to the interior sidewall 100 of a jewelry piece 102. Referring to FIGS. 5 and 6, there is illustrated the present invention of the collet 40 is affixed to the interior sidewall 100 of a jewelry piece 102. For example, in one embodiment illustrated in FIG. 5, the exterior sidewall 43 of the collet 40 is directly welded to the interior sidewall 100 of the jewelry piece 102 as illustrated in the upper portion of FIG. 5. In addition or alternatively, the exterior sidewall 43 of the collet 40 is connected to the interior sidewall 100 of the jewelry piece through connection of a short metal connecting member 60. One end 62 of the connecting member 60 is welded or otherwise attached to the exterior surface 43 of the collet 40 and the opposite end 64 of the connecting member 60 is welded or otherwise attached to the interior sidewall 100 of the jewelry piece 102. In both settings, an outer edge of the girdle 16 is positioned adjacent the interior sidewall 100 of the jewelry piece 102 so that the short metal connecting member 60 and the collect 40 are invisible when the jewelry piece 102 is viewed from above. Therefore, the diamond 10 which is set appears to be "floating" in the jewelry piece 102 when viewed form above the jewelry piece after affixing the collet 40 to the jewelry piece 102. This is because, as specifically illustrated in FIGS. 5 and 7, the size of the girdle portion 16 is larger than the size of the collet 40 and the length of the short metal connecting member 60, so that the top portion of the diamond 10 including the crown 12 and girdle 16 shields the top of the collet 40 and the short metal connecting member 60 from the outside view. Therefore, the present invention creates an invisible diamond mounting structure, which includes the collet 40 of the jewelry piece 102 having the claws 46, the diamond 10 having the grooves 22, and the short metal connecting member 60. It will be appreciated that the above illustrated metal connecting member can also be manufactured through a step of metal casting. In addition, at least one short connecting member can be applied between the collet and jewelry piece.

Figure 7:
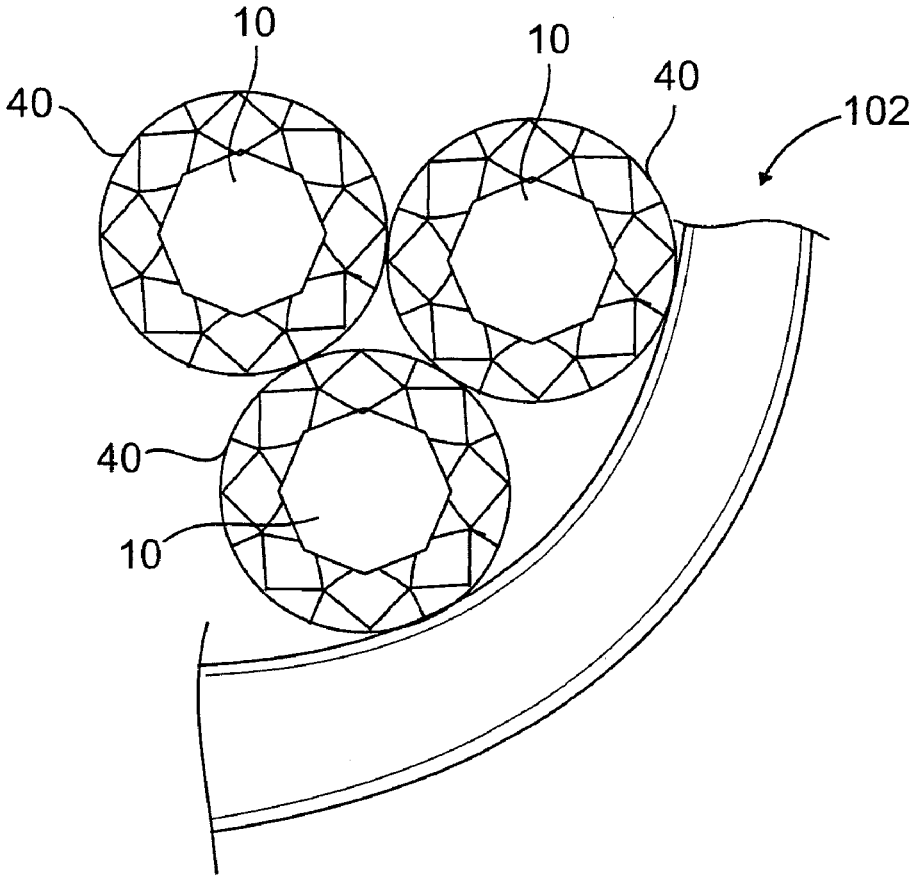
FIG. 7 is a top plan view of a stone set within the jewelry piece so that it appears to be floating in the jewelry piece.

It will be appreciated that, applying the above illustrated stone mounting structure, multiple stones which are retained by the respective collets can be set into the jewelry piece 102 so that the present invention can include a multiplicity of the "floating" stones. As illustrated in FIG. 7, collets 40 which are positioned adjacent the interior sidewall 100 of the jewelry piece 102 are connected to the interior sidewall 100 as described above. The collets 40 which are positioned in the center of the jewelry piece 102 are respectively connected to adjacent collets 40.

The above illustration discloses a preferred embodiment of the present invention floating stones including diamonds, comprising the invisible mounting structure which includes the preferred three pairs of the identical grooves and claws of each respective diamond and collet. However, it is within the spirit and scope of the present invention for the grooves and claws to be different and are not limited to being identical. For example each pair of the respective groove and claw can be different depending on the specific shape of the stone. In addition, at least two pairs of the grooves and claws can be used in each collet. Furthermore, the body of the collet can be any type of shape to accommodate a specific stone, and the jewelry piece can also be any types of shapes.

It will be appreciated that, in accordance with the above illustrated "floating diamond", the method of the present invention to manufacture the diamond is comprised of connecting the collet which retains the diamond to the interior sidewall of the jewelry piece, creating a model of the jewelry item, putting the model through a vulcanization process to create a rubber mold and creating a wax impression which has the same impression as the mold, setting the stones, and casting the jewelry item in a precious metal.

It will be further appreciated that according to the steps of manufacturing one "floating diamond", the present invention method can also manufacture a multiplicity of "floating diamonds" which are retained by the respective collets, wherein some of the collets are positioned adjacent the interior sidewall of the jewelry piece and other collets are positioned within the jewelry piece but not adjacent the interior sidewall. Therefore, each of the collets positioned adjacent the interior sidewall of the jewelry piece are connected as described above. Collets which are positioned away from the interior sidewall are connected to adjacent collets.

It will also be appreciated that the collet and jewelry piece of the present invention can be made with various types of metals or metal alloys, consisting of white gold, yellow gold, rose gold and platinum.

Defined in detail, the present invention is a jewelry piece having an interior sidewall and retaining at least one stone, comprising: (a) said stone comprising a top crown, a bottom tip, a girdle, and a pavilion portion having a multiplicity of facets, wherein, a multiplicity of grooves are cut into the facets and located beneath said girdle; (b) a collet comprising a body which has an interior chamber, an exterior sidewall and a multiplicity of extensions spaced at top of said collet, wherein each of the extensions is comprised of a claw which is positioned at the top of a respective extension to project inwardly towards the interior chamber, said stone is affixed to the collet by inserting a respective claw into a respective groove; and (c) said exterior side of said collet is affixed to said interior sidewall of said jewelry piece through a short metal connecting member, wherein an outer edge of said girdle of said stone is positioned adjacent said interior sidewall of said jewelry piece so that said short metal connecting member and said collet are invisible when viewed from outside of the jewelry piece which causes said stone to appear to be "floating" in said jewelry piece.

Defined more broadly, the present invention is a jewelry piece having an interior sidewall and retaining at least one stone, comprising: (a) said stone comprising at least a girdle and a pavilion portion having a multiplicity of facets, wherein, a multiplicity of grooves are cut into the facets and located beneath said girdle; (b) a collet comprising a body which has an interior chamber, an exterior sidewall and a multiplicity of extensions spaced at top of said collet, wherein each of the extensions is comprised of a claw which is positioned on a respective extension so that the claw projects inwardly towards the interior chamber, said stone is affixed to the collet by inserting a respective claw into a respective groove; and (c) said exterior side of said collet is affixed to said interior sidewall of said jewelry piece so that an outer edge of said girdle of said stone is positioned adjacent said interior sidewall of said jewelry piece so that said collet is invisible when viewed from outside of the jewelry piece which causes said stone to appear to be "floating" in said jewelry piece.

Defined as a method, the present invention is a method of setting a stone having a girdle in a jewelry piece having an interior sidewall, comprising the steps of:(a) creating a model of the jewelry piece including a collet having an exterior sidewall, further comprising connecting said collet which retains said stone to said interior sidewall of said jewelry piece through connection of a short metal connecting member; (b) putting said model through a vulcanization process to create a rubber mold; (c) creating a wax impression which has the same impression as said mold; (d) setting said stone into said wax impression; and (e) casting said jewelry piece in a precious metal so that said exterior sidewall of said collet is affixed to said interior sidewall of said jewelry piece, wherein an outer edge of a girdle of said stone which is positioned adjacent said interior sidewall of said jewelry piece shields said short metal connecting member and said collet, which causes said stone to appear to be "floating" in said jewelry piece when said jewelry piece is viewed.

The method is more broadly defined as a method to set a stone having a girdle and retained in a collet of a jewelry piece having an interior sidewall including the steps of creating a model of the jewelry piece, putting said model through a vulcanization process to create a rubber mold, creating a wax impression which has the same impression as said mold, setting said stone, and casting said jewelry piece in a precious metal, wherein the method further comprises: (a) connecting said collet to said interior sidewall of said jewelry piece in said step of creating said jewelry model, so that after casting said jewelry piece said collet is affixed to said interior sidewall of said jewelry piece, so that an outer edge of said girdle of said stone is positioned so as to shield said collet which causes said stone to appear to be "floating" in said jewelry piece.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A jewelry piece having an interior sidewall and retaining at least one stone, comprising:

a. said stone comprising a top crown, a bottom tip, a girdle, and a pavilion portion having a multiplicity of facets, wherein, a multiplicity of grooves are cut into the facets and located beneath said girdle;

b. a collet comprising a body which has an interior chamber, an exterior sidewall and a multiplicity of extensions spaced at top of said collet, wherein each of the extensions is comprised of a claw which is positioned at the top of a respective extension to project inwardly towards the interior chamber, said stone is affixed to the collet by inserting a respective claw into a respective groove;

c. said exterior sidewall of said collet is affixed to said interior sidewall of said jewelry piece through a short metal connecting member, wherein an outer edge of said girdle of said stone is positioned adjacent said interior sidewall of said jewelry piece so that said short metal connecting member and said collet are invisible when viewed from outside of the jewelry piece; and d. said jewelry piece further comprising a multiplicity of collets retaining respective stones, wherein collets which are placed adjacent the interior sidewall of the said jewelry piece are respectively connected to the interior sidewall of said jewelry piece, and collets which are positioned away from the interior sidewall of the jewelry piece are connected to adjacent collets.

2. The jewelry piece in accordance with claim 1 wherein said stone is a diamond.

3. The jewelry piece in accordance with claim 1, wherein said jewelry piece is made with metal materials consisting of white gold, yellow gold, rose gold and platinum.

4. The jewelry piece in accordance with claim 1 wherein the multiplicity of grooves cut within a stone comprises at least three grooves and each collect has at least three claws with a claw respectively inserted into a groove.

5. The jewelry piece in accordance with claim 1 wherein the short metal connecting member is welded to the interior sidewall of the jewelry piece.

6. The jewelry piece in accordance with claim 1 wherein the short metal connecting member is affixed at one end to the sidewall of the collet and affixed at an opposite end to the interior sidewall of the jewelry piece.

7. A jewelry piece having an interior sidewall and retaining a multiplicity of stones, comprising:

a. said stones each comprising at least a girdle and a pavilion portion having a multiplicity of facets, wherein a multiplicity of grooves are cut into the facets and located beneath said girdle;

b. a multiplicity of collets each comprising a body which has an interior chamber, an exterior sidewall and a multiplicity of extensions spaced at top of said collet, wherein each of the extensions is comprised of a claw which is positioned on a respective extension so that the claw projects inwardly towards the interior chamber, said stone is affixed to the collet by inserting a respective claw into a respective groove;

c. wherein more than one collet of said multiplicity of collets are placed adjacent and are respectively connected to the interior sidewall of said jewelry piece, and collets which are positioned away from the interior sidewall of the jewelry piece are connected to adjacent collets; and d. wherein each exterior sidewall of said more than one collet is affixed to said interior sidewall of said jewelry piece so that an outer edge of said girdle of said stone is positioned adjacent said interior sidewall of said jewelry piece so that said collet is invisible when viewed from outside the jewelry piece.

8. The jewelry piece in accordance with claim 7 wherein each sidewall of said more than one collet is directly affixed to the interior sidewall of the jewelry piece by being directly welded to an interior sidewall of the jewelry piece.

9. The jewelry piece in accordance with claim 7 wherein each collet of said more than one collet is affixed to the interior sidewall of the jewelry piece through a connecting member affixed at one end to the sidewall of the collet and affixed at an opposite end to the interior sidewall of the jewelry piece.

10. The jewelry piece in accordance with claim 7 wherein each of said stones is a diamond.

11. The jewelry piece in accordance with claim 7, wherein said jewelry piece is made with metal materials consisting of white gold, yellow gold, rose gold and platinum.

12. The jewelry piece in accordance with claim 7 wherein the multiplicity of grooves cut within each of said stones comprises at least three grooves and each collet has at least three claws with a claw respectively inserted into a groove.

* * * * *